United States Patent [19]

Oliver

[11] Patent Number: 4,986,681

[45] Date of Patent: Jan. 22, 1991

[54] WATERPROOF DISHWASHING MITTEN

[76] Inventor: Willie R. Oliver, 164 S. Portland Ave., Brooklyn, N.Y. 11217

[21] Appl. No.: 421,663

[22] Filed: Oct. 16, 1989

[51] Int. Cl.[5] ..... A46B 5/04; A47K 7/03

[52] U.S. Cl. ..... 401/7; 401/8

[58] Field of Search ..... 401/7, 8, 201

[56] References Cited

U.S. PATENT DOCUMENTS

| | | | |
|---|---|---|---|
| 1,713,065 | 5/1929 | Williams | 401/201 |
| 2,210,754 | 8/1940 | Frank | 401/7 |
| 2,353,772 | 7/1944 | Topjian | 401/7 |
| 2,569,067 | 9/1951 | Liushin | 401/7 X |
| 2,595,882 | 5/1952 | Pierce | 401/7 |
| 2,795,806 | 6/1957 | Suttles | 401/7 |
| 3,167,077 | 1/1965 | Bosko et al. | 401/8 |
| 4,154,542 | 5/1979 | Rasmason | 401/7 |
| 4,457,640 | 7/1984 | Anderson | 401/7 |

FOREIGN PATENT DOCUMENTS

| | | | |
|---|---|---|---|
| 917908 | 9/1946 | France | 401/7 |
| 899016 | 6/1962 | United Kingdom | 401/7 |

*Primary Examiner*—Steven A. Bratlie

*Attorney, Agent, or Firm*—Richard L. Miller

[57] ABSTRACT

A waterproof dishwashing mitten is provided and consists of an inner pocket for receiving a hand of a person, a middle liner for protecting the inner pocket from moisture and keeping the hand dry, and outer pocket for washing the dishes, and elastic band sewn on the outer pocket to provide a wrist-hugging and enlargeable entrance to the inner pocket, a loop to hang up the mitten, a mesh net bag for retaining a soap therein and which can be placed through an elongated slot in the outer pocket that can be opened and closed to release and retain the mesh net bag.

8 Claims, 1 Drawing Sheet

WATERPROOF DISHWASHING MITTEN

BACKGROUND OF THE INVENTION

The instant invention relates generally to washcloths and more specifically it relates to a waterproof dishwashing mitten.

Numerous washcloths have been provided in the prior art that are adapted to be hand held and contain soap so that the washcloths can be used for washing. For example, U.S. Pat. No. 2,569,067 to Livshin; 2,595,882 to Pierce; 2,668,309 to Colgan; 3,581,447 to Falivene; 4,154,542 to Rasmason and 4,457,640 to Anderson all are illustrative of such prior art. While these units may be suitable for the particular purpose to which they address, they would not be as suitable for the purpose of the present invention as hereafter described.

SUMMARY OF THE INVENTION

A primary object of the present invention is to provide a waterproof dishwashing mitten that will overcome the shortcomings of the prior art devices.

Another object is to provide a waterproof dishwashing mitten that will protect the hand of a person using the mitten from dishwashing detergents and the like.

An additional object is to provide a waterproof dishwashing mitten in which a conventional plastic bag or a latex rubber bag can be utilized as a middle protection liner for the hand of the person using the mitten.

A further object is to provide a waterproof dishwashing mitten that is simple and easy to use.

A still further object is to provide a waterproof dishwashing mitten that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
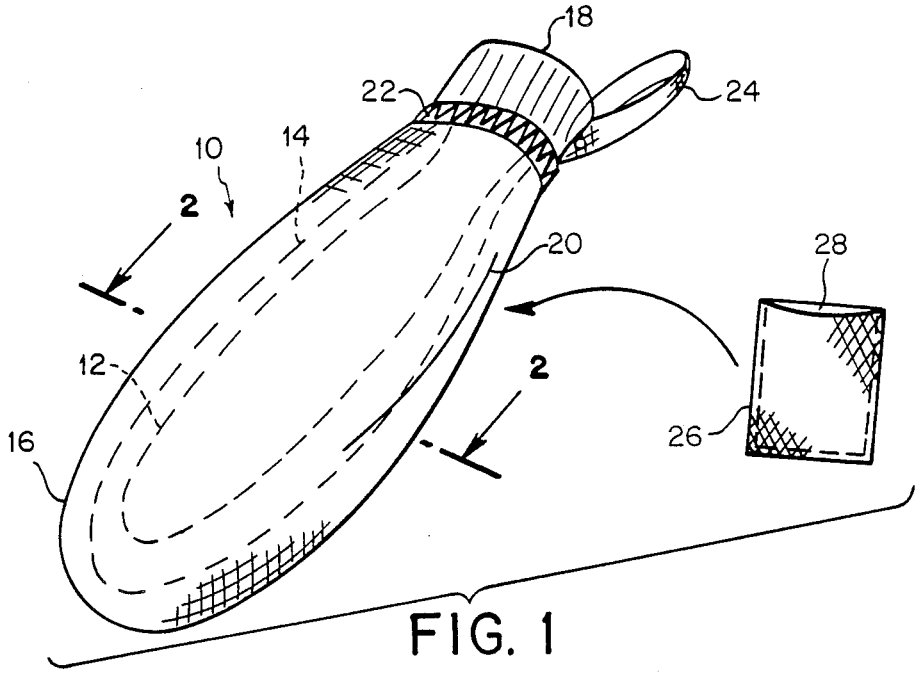
FIG. 1 is a perspective view of the instant invention.
Figure 2:
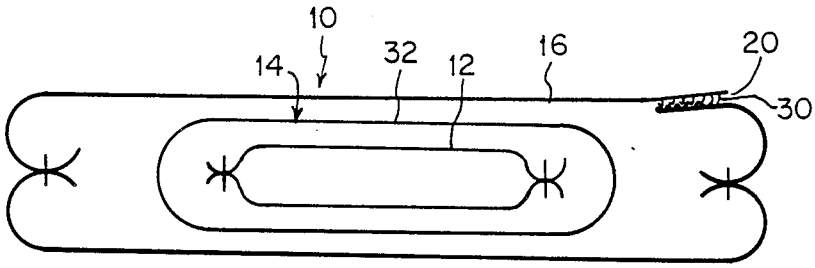
FIG. 2 is a diagrammatic cross sectional view taken along line 2—2 in FIG. 1.

Turning now descriptively to the drawings, in which like reference characters denote like elements throughout the several views, FIGS. 1 and 2 illustrate a waterproof dishwashing mitten 10 consisting of an inner pocket 12 of flexible fabric material for receiving a hand of a person (not shown). A middle liner 14 is provided for protecting the inner pocket 12 from moisture and keeps the hand of the person dry. An outer pocket 16 of flexible absorbent material has an open end 18 for receiving the middle liner 14 and the inner pocket 12. The outer pocket 16 further has an elongated slot 20 at one side thereof.

An elastic band 22 is sewn on the outer pocket 16 and through the middle liner 14 and the inner pocket 12 at the open end 18 thereof to provide a wrist-hugging and elastically enlargeable entrance to the inner pocket 12. A loop cloth strip 24 is stitched into the seam of the elastic band 22 so that the mitten 10 can be hung up when not being used. A mesh net bag 26 has an opening 28 for insertion of soap therein and is of a size to be placed through the elongated slot 20 in the outer pocket 16. A VELCRO® hook and loop pile, snap or zipper fastener 30 is secured to the elongated slot 20 for opening and closing the elongated slot to release and retain the mesh net bag 26.

The inner pocket 12 is made typically out of cotton material to comfortably cover the hand of the person. The outer pocket 16 is made typically out of polyester material with a cleansing and flushing texture so that dishes can be cleaned. The middle liner is made typically out of flexible non-absorbent non-porous plastic material 32 to cover the inner pocket 12.

Figure 3:
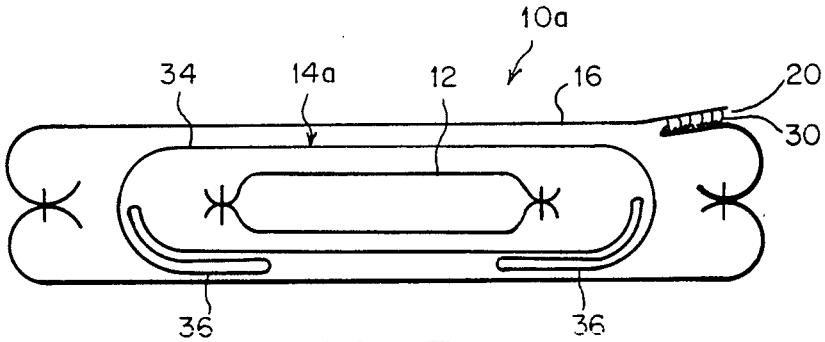
FIG. 3 is a diagrammatic cross sectional view similar to FIG. 2 showing a modification in which the middle liner is a conventional plastic or latex rubber bag having ends folded over within the unit.

A modified waterproof dishwashing mitten **10*a* is shown in FIG. 3 wherein the middle liner 14*a* is a conventional latex rubber or plastic bag 34 having ends 36 folded over within the outer pocket 16 to cover the inner pocket 12**.

To use the mitten 10, a person simply separates the VELCRO® hook and loop pile, snap or zipper fastener 30 along the elongated slot 20 and places the mesh net bag 26 containing the soap, which can be a bar or powder, into the outer pocket 16 and reseals the elongated slot 20. The hand is then placed into the inner pocket 12 so that the entire mitten can be submerged into hot water to wash the dishes.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A waterproof dishwashing mitten comprising:

(a) an inner pocket of flexible fabric material for receiving a hand of a person;

(b) a middle liner of flexible, non-absorbent, non-porous material covering said inner pocket for protecting said inner pocket from moisture and keeping the hand of the person dry;

(c) an outer pocket of flexible absorbent material having an open end for receiving said middle liner and said inner pocket, said outer pocket further having an elongated slot at one side thereof;

(d) an elastic band sewn on said outer pocket and through said middle liner and said inner pocket at the open end thereof to provide a wrist-hugging and elastically enlargeable entrance to said inner pocket;

(e) a loop cloth strip stitched into the seam of said elastic band so that said mitten can be hung up when not being used;

(f) a mesh net bag having an opening for insertion of soap therein and being of a size to be placed through said elongated slot in said outer pocket; and (g) means for opening and closing said elongated slot to release and retain said mesh net bag.

2. A waterproof dishwashing mitten as recited in claim 1, wherein said opening and closing means includes a hook and loop pile fastener secured to said elongated slot.

3. A waterproof dishwashing mitten as recited in claim 2, wherein said inner pocket is made out of cotton material to comfortably cover the hand of the person.

4. A waterproof dishwashing mitten as recited in claim 3, wherein said outer pocket is made out of polyester material with a cleansing and flushing texture so that dishes can be cleaned.

5. A waterproof dishwashing mitten as recited in claim 4, wherein said middle liner, is made out of plastic material.

6. A waterproof dishwashing mitten as recited in claim 4, wherein said middle liner, is made out of latex rubber material.

7. A waterproof dishwashing mitten as recited in claim 4, wherein said middle liner is a conventional plastic bag having ends folded over within said outer pocket to cover said inner pocket.

8. A waterproof dishwashing mitten as recited in claim 4, wherein said middle liner is a conventional latex rubber bag having ends folded over within said outer pocket to cover said inner pocket.

* * * * *